US005260532A

United States Patent [19]

Tinder et al.

[11] Patent Number: 5,260,532

[45] Date of Patent: Nov. 9, 1993

[54] SEALED HOUSING FOR A REMOTE SWITCHING DEVICE

[75] Inventors: David V. Tinder, Dearborn; Frank S. Loria, Hartland, both of Mich.

[73] Assignee: United Technologies Automotive, Inc., Dearborn, Mich.

[21] Appl. No.: 786,624

[22] Filed: Nov. 1, 1991

[51] Int. Cl.[5] ..... H01H 9/04

[52] U.S. Cl. ..... 200/302.1; 200/292; 277/166

[58] Field of Search ..... 200/292, 302.1, 302.2, 200/302.3, 303; 277/166, 212 R, 212 C, 212 F, 901

[56] References Cited

U.S. PATENT DOCUMENTS

| | | | |
|---|---|---|---|
| 2,409,483 | 10/1946 | Gandelot | 200/302.2 X |
| 2,984,725 | 5/1961 | Hubbell et al. | 200/302.2 |
| 3,932,721 | 1/1976 | Crowell et al. | 200/302.2 |
| 3,967,085 | 6/1976 | Lockard et al. | 200/302.2 |
| 3,996,428 | 12/1976 | Buan et al. | 200/5 A |
| 4,022,993 | 5/1977 | Shattuck | 200/303 X |
| 4,029,916 | 6/1977 | Chu | 200/5 A |
| 4,032,729 | 6/1977 | Koistinen | 200/5 A |
| 4,105,882 | 8/1978 | Ulbing et al. | 200/302.3 X |
| 4,128,744 | 12/1978 | Seeger | 200/5 A |
| 4,160,886 | 7/1979 | Wright et al. | 200/5 A |
| 4,190,748 | 2/1980 | Langford | 200/5 A |
| 4,315,114 | 2/1982 | Monti, Jr. | 200/5 A |
| 4,323,740 | 4/1982 | Balash | 200/5 A |
| 4,473,724 | 9/1984 | Suzuki | 200/5 R |
| 4,678,872 | 7/1987 | Gutman | 200/5 R |
| 4,843,763 | 7/1989 | Mesnel | 277/166 X |
| 4,947,461 | 8/1990 | Yoshioka et al. | 200/302.1 X |

FOREIGN PATENT DOCUMENTS

| | | | |
|---|---|---|---|
| 0329920 | 8/1989 | European Pat. Off. . | |
| 193595 | 5/1905 | Fed. Rep. of Germany | 21/34 |
| 3809295 | 9/1989 | Fed. Rep. of Germany . | |
| 3933877 | 4/1990 | Fed. Rep. of Germany . | |
| 449740 | 4/1968 | Switzerland | 21/30 |
| 2140623 | 11/1984 | United Kingdom | 200/302.2 |

*Primary Examiner*—Henry J. Recla
*Assistant Examiner*—Glenn T. Barrett
*Attorney, Agent, or Firm*—Randy G. Henley

[57] ABSTRACT

A housing assembly (14) for protection of an enclosed printed circuit board (12) with a surface mounted dome switch (18) is disclosed. Various construction details are developed which provide sealing under a variety of atmospheric conditions. In one embodiment, the housing assembly is comprised of an upper portion (22), a lower portion (26), and a one piece, continuous diaphragm (30). The upper portion has an aperture (24) for engagement of a button actuator (20) by an external force. The diaphragm, composed of an elastic material, provides a sealed cavity (32) for the housing and permits substantial equalization between the internal and external pressure of the sealed cavity.

13 Claims, 1 Drawing Sheet

SEALED HOUSING FOR A REMOTE SWITCHING DEVICE

DESCRIPTION

1. Technical Field

This invention relates to remote switching devices, and more particularly to sealed housings for remote switching devices.

2. Background

Remote switching devices typically employ a rigid housing to enclose various electrical components necessary for the device. The electrical components include numerous switches mounted directly on a printed circuit board. The switches are actuated through an aperture in the housing. In many applications, such as the automotive industry, the portability of the remote switching device exposes it to environments which may be injurious. Therefore, the housing is required to provide protection for the electrical components from damage due to inadvertent impact and contaminants such as dirt and, particularly, moisture.

One approach to constructing housings for remote switching devices is to provide an aperture in the housing which permits the projection of a button for actuating each switch. While this approach is economical, it allows for a breach of the housing when the button is depressed. This breach may cause a degradation in the performance of the electrical components due to the penetration of dirt and moisture into the housing.

A solution applied in the automotive industry to this problem is to provide a seal, such as a flexible gasket attached to both the button and the housing around the aperture for each button. This solution maintains a seal during actuation but becomes cost prohibitive as the number or buttons per device increases and as the number of devices produced increases. In the automobile industry, where production quantities are high, even nominal increases in manufacturing costs can be cost prohibitive.

In the electronic keyboard industry it is well known to use a single flat sheet overlay which covers the electrical components to provide protection against contamination by dust and other debris, as disclosed in U.S. Pat. Nos. 3,996,428 and 4,160,886. No seal is provided between the overlay and the adjacent structure.

The above art notwithstanding, scientists and engineers under the direction of Applicants+ Assignee are working to develop improved housings for remote switching devices.

DISCLOSURE OF INVENTION

This invention is in part predicated upon a recognition of the need for housings for remote switches to maintain a sealed internal environment for the switch even though conditions in the external environment cause a difference in pressure between the internal environment and the external environment. One example of an external environment causing such a pressure difference is the outdoors where temperature and humidity can fluctuate widely. Typically, a pressure difference occurs when the remote switch is placed in an external environment which is colder than the internal environment (interior) of the housing. The interior of the housing cools causing a reduction in pressure within the housing. A pressure differential between the housing interior and the external environment encourages the sealed housing to equalize the pressure differential by breaching the seal. If a breach occurs, moisture and other contaminants in the external environment may be pulled into the housing and may degrade the functioning of the switch circuitry.

An object of the present invention is a housing for a remote switching device which provides a means to actuate internal switches within a sealed environment.

Another object of the invention is a housing which provides a mechanism for pressure equalization when a pressure differential occurs between the internal and external pressure.

According to the present invention, a housing assembly for a remote switching device is comprised of a lower portion and a one piece, continuous diaphragm which, in conjunction with the lower portion, forms a sealed cavity for the switching device and which is readily movable in response to pressure differences.

In accordance with one detailed embodiment of the present invention, the lower portion is relatively rigid and the housing assembly further includes an upper portion, also relatively rigid, which joins the lower portion to form a rigid outer shell for the switching device and which has an aperture which permits access to the switching device.

According further to the present invention, the lower portion includes a sealing groove disposed about the periphery of the lower portion and the diaphragm includes a sealing bead, having a resilient spur, disposed about the periphery of the diaphragm. The spur is shaped such that it deforms by bending towards the diaphragm upon placement within the sealing groove. This deformation maintains the seal and discourages the sealing bead from sliding out of the sealing groove.

Still further, a method for producing a sealed housing assembly includes: first, positioning an electrical assembly between a lower portion having a sealing groove and a diaphragm having a sealing bead; second, positioning an an upper portion outward of the diaphragm; third, forcing the upper and lower portions together and thereby forcing the sealing bead into the sealing groove; and fourth, securing the upper portion to the lower portion.

A primary feature of the present invention is the flexible diaphragm which forms a portion of the sealed enclosure. Another feature is the separate, rigid upper portion which covers the diaphragm while permitting the diaphragm to remain flexible. A further feature of the present invention is the resilient spur located on the sealing bead which deforms upon insertion into the sealing groove and locks the sealing bead into place to maintain the integrity of the seal.

A primary advantage of the present invention is that pressure equalization without a breach of the sealed housing occurs as a result of the use of a flexible diaphragm . Under conditions which produce a pressure differential the diaphragm will move to accommodate and substantially eliminate the pressure differential. Typically this will involve a situation in which the pressure internal to the housing is less than the external pressure, in which case the diaphragm will pull away from the upper portion and collapse down until the pressure differential is substantially eliminated. Additional advantages of the present invention result from using a single flexible diaphragm. Since the diaphragm is a single, continuous layer, the number of parts to be produced is reduced, which results in lowered costs. The single diaphragm also improves reliability by reducing the number of breaching paths. In addition, the diaphragm provides a soft contact surface during actuation of the switch.

Further advantages of the present invention result from having an upper portion separate from the diaphragm. The upper portion combines with the lower portion to form a rigid outer shell for the electrical components used in a remote switching device. The rigid outer shell protects the switching device from damage due to impact without affecting the ability of the invention to accommodate pressure differences.

The foregoing and other objects, features and advantages of the present invention will become more apparent in light of the following detailed description of exemplary embodiments thereof, and as illustrated in the accompanying drawings.

BEST MODE FOR CARRYING OUT THE INVENTION

Figures 1, 2, 3, 4:
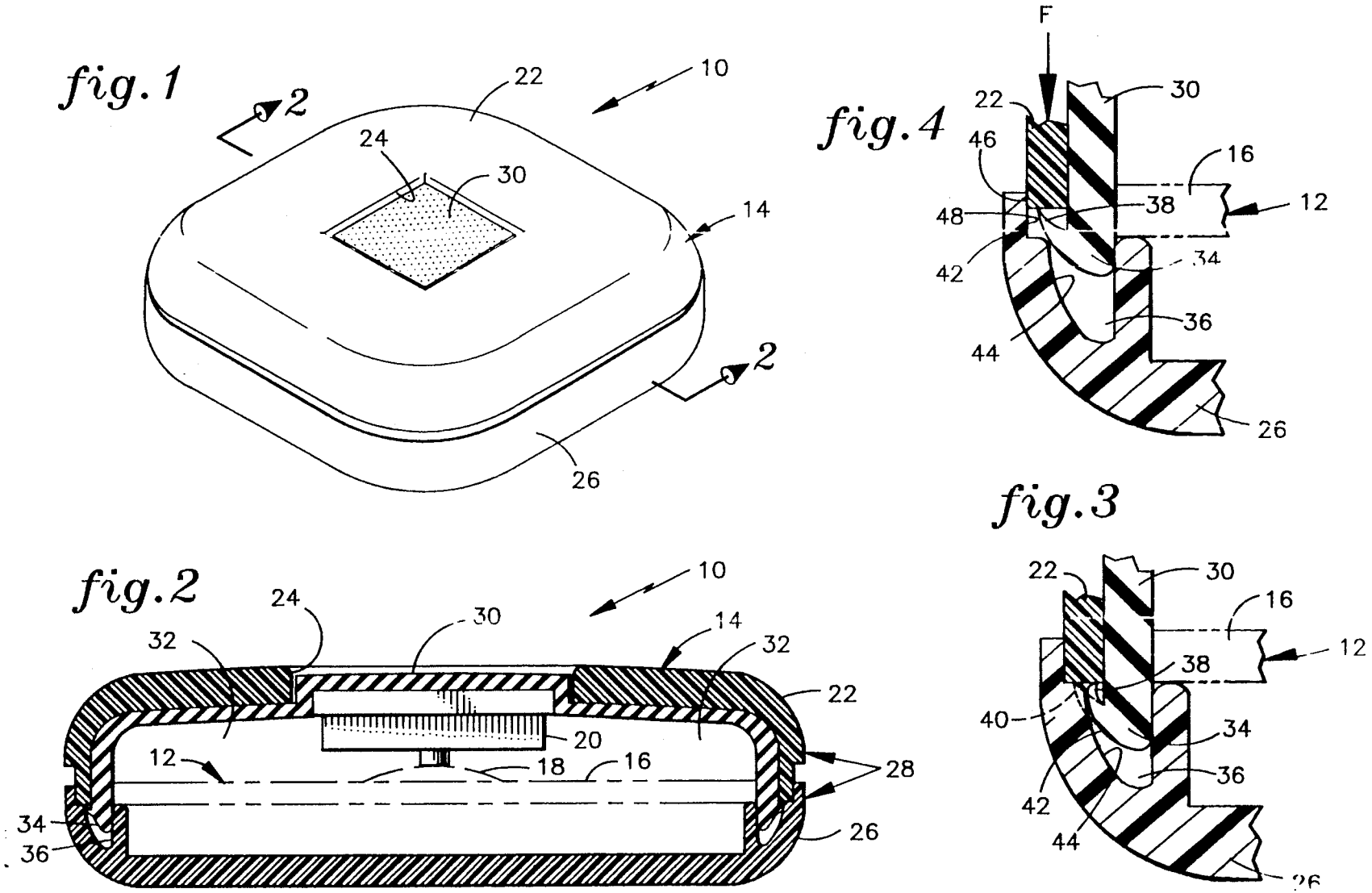
FIG. 1 is a perspective view of a housing assembly for a remote switching device.
FIG. 2 is a cross-sectional view, taken along line 2—2 of FIG. 1, showing the housing assembly and internal components of the remote switching device.
FIG. 3 is a sectional view showing the interaction of a sealing bead and sealing groove.
FIG. 4 is a sectional view of a sealing bead and sealing groove prior to assembly of a remote switching device.

Referring to FIGS. 1 and 2, a remote switching device 10 is comprised of an electrical assembly 12 and a housing assembly 14. The electrical assembly 12 includes a printed circuit board 16, a dome switch 18, and a button actuator 20. The housing assembly 14 includes an upper portion 22 having an aperture 24, a lower portion 26 which joins the upper portion 22 to form an outer shell 28, and a diaphragm 30. A sealed cavity 32 is defined by the lower portion 26, having a sealing groove 36, and the diaphragm 30, having sealing means defined by a sealing bead 34 with a resilient spur 38.

The upper portion 22 and lower portion 26 are formed from relatively rigid materials such that the outer shell 28 is a rigid frame which provides protection against inadvertent impact. A suggested material for the outer shell 28 is ABS Polycarbonate, pulse 930 sold by Dow Plastics, Midland, Mich. The joining of the upper and lower portions 22, 26 may be accomplished by any conventional means, such as by bonding or using fasteners.

The dome switch 18 is actuated by an external force applying member (not shown), which is applied through the aperture 24 in the upper portion 22 and engages the button actuator 20. The diaphragm 30, which is an interface between the external force applying member and the button actuator 20, provides a soft, non-slip contact surface for the force applying member.

The diaphragm 30 is a one piece, continuous (i.e. no openings or apertures) layer fabricated from a suitably flexible material, such as a thermoplastic elastomer, which extends from the juncture of the upper and lower portions 22, 26 to cover the electrical assembly 12. The diaphragm 30 engages the lower portion 26 to provide the sealed cavity 32 for the electrical assembly 12 when the upper and lower portions 22,26 are joined together.

The sealed cavity 32 is maintained by the abutting contact between the sealing bead 34 located about the periphery of the diaphragm 30 and the sealing groove 36 located about the periphery of the lower portion 26. As shown more clearly in FIG. 3, the sealing bead 34, which is forced into the sealing groove 36 during assembly, has a resilient spur 38 sized and shaped such that the compression and deformation of the spur 38 upon confinement within the sealing groove 36 provides a sealing force to protect against the penetration of external contaminants through the sealing groove 36.

The spur 38 is adapted to both seal the cavity 32 and to prevent the sealing bead 34 from sliding out of the sealing groove 36 by trapping the sealing bead 34 within the sealing groove 36. The spur 38 is shaped such that in its natural, uninstalled condition it has a width which extends beyond the space provided in the sealing groove 36. This is shown by a dotted line 40 in FIG. 3 which corresponds to the natural shape of the spur 38. Insertion of the sealing bead 34 into the sealing groove 36 produces the installed condition. The sealing groove 36 exerts a longitudinal force which compresses and longitudinally deforms the spur by bending the spur 38 in towards the diaphragm 30. If a force is applied to pull the sealing bead 34 out of the sealing groove 36, friction between a surface 42 of the spur 38 and an adjacent surface 44 of the sealing groove 36 will force the spur 38 to attempt to bend away from the diaphragm 30 while still constrained within the sealing groove 36. This motion will place additional compressive force on the sealing bead 34 which will resist the motion. In effect, the spur 38 provides a trapping mechanism.

Referring now to FIG. 4, production of the invention is reduced to a few simple steps which will reduce the costs associated with mass production of the invention. First, the electrical assembly 12 is placed between the lower portion 26 and the diaphragm 30. Second, the upper portion 22 is positioned outward of the diaphragm 30. The third step is to force together the upper portion 22 and the lower portion 26 by application of a force F, sufficient to engage a mating edge 46 on the upper portion 22 with a mating edge 48 on the lower portion 26. During the third step the upper portion 22 drives the sealing bead 34 vertically down into the sealing groove 36 and the sealing bead is deformed longitudinally within the sealing groove 36. The arrangement of the surface of the upper portion 22 and the adjacent peripheral edge of the printed circuit board 16 form a passage which provides lateral support for the diaphragm 30 to prevent buckling during the third step. The final step is to secure the upper portion 22 and lower portion 26 together by any convenient means, such as by fastening or bonding.

During operation, the diaphragm 30 provides a mechanism to accommodate pressure differentials without a breach of the sealed cavity 32. For instance, when the switching device is immersed in a cold (relative to the temperature internal to the housing 14) fluid the consequent drop in temperature in the air within the sealed cavity produces a corresponding drop in the internal pressure. The drop in internal pressure causes a pressure differential to exist between the atmosphere internal to the sealed cavity and the fluid external to the housing and creates a partial vacuum within the sealed cavity. Unless this differential can be accommodated it may generate a breach of the sealed cavity and allow the external fluid to contaminate the switching device. The entire non-seal portion of the diaphragm, due to its having a sufficient flexibility characteristic and being separate from the upper portion, is permitted to move and can thereby substantially equalize the pressure differential without a breach. In the instance described above the non-seal diaphragm will collapse down to accommodate the higher external pressure. Although it may not be necessary to completely eliminate any measurable pressure difference, the pressure difference must be reduced such that any remaining pressure difference is insufficient to cause a breach. The amount of allowable pressure difference is dependent on the sealing mechanism.

Simple tests exist to determine whether substantial equalization of the pressure difference occurs to maintain the integrity of the sealed cavity. One such test is to immerse a room temperature (twenty (20) to twenty-two (22) degrees Celsius) switching device in a container of zero (0) degree Celsius, five (5) percent salt water solution to a depth of three (3) inches. The switching device remains immersed in the salt water solution for five (5) minutes. As the temperature within the sealed cavity decreases a partial vacuum is created within the cavity which generates a pressure difference across the diaphragm. Unless the diaphragm can deflect and substantially equalize the pressure difference, the seal may be breached and moisture may contaminate the internal circuitry of the switching device. Upon removal from the container, the switching device is operationally tested to determine if all internal circuits are functioning properly. The housing is also opened and examined for the presence of any moisture. The embodiment illustrated in FIGS. 1-4 passed this test.

The material selected for the diaphragm must have a sufficient flexibility characteristic to be readily movable in response to the pressure differentials encountered. Testing suggests that materials with hardness durometers of 62 or less will have sufficient flexibility for this purpose. Additionally, the diaphragm must maintain this flexibility over the temperature range which the remote switching device will be exposed to. For automotive applications this temperature range is from −40° C. to 85° C. Another factor in selecting a diaphragm material is the thickness of the diaphragm. Although flexibility requirements are a consideration, other considerations such as molding capabilities and available space within the housing assembly may also factor into the determination of the diaphragm thickness. One satisfactory material for the diaphragm is Krayton G, product number 7720-62A, which is sold by Shell Chemical Company, Troy, Mich.

Although FIGS. 1 and 2 illustrate a switching device with a single switch, it should be obvious to those skilled in the art that a plurality of switches may be utilized with each switching device. Additionally, although a button diaphragm switch was described as being particularly useful for the embodiment illustrated in FIGS. 1 and 2, the selection of this type of switch is not limiting and it should be understood that a variety of other types of mechanically actuated switches are equally applicable in the present invention, as well as combinations of various types of switches. Examples of other types of mechanically actuated switches which are applicable to the present invention are: conductive rubber pad switches, membrane switches, clicket switches, and tact switches.

Although the invention has been shown and described with respect to exemplary embodiments thereof, it should be understood by those skilled in the art that various changes, omissions and additions may be made therein and thereto, without departing from the spirit and the scope of the invention.

We claim:

1. An improved portable, remote switching device of the type having a switch and a housing assembly adapted to permit actuation of the switch by engagement between the housing and a force applying member, wherein the housing assembly comprises:

a continuous first portion having a sealing groove extending peripherally about said first portion, said first portion being relatively rigid;

a second portion having an aperture which permits application of the force applying member to the switch, said second portion being relatively rigid and engaged with said first portion to form a junction therebetween and to provide a rigid outer shell adapted to protect the switch; and a one piece, continuous diaphragm which extends from the junction between said first and second portions, said diaphragm being spaced from said first portion leaving a sealed cavity therebetween for the switch, the sealed cavity having no communication with the external environment of the sealed cavity, and said diaphragm having a flexibility characteristic which adapts said diaphragm to be readily moveable in response to a pressure difference between a pressure internal and a pressure external to the sealed cavity, wherein such movement includes said diaphragm pulling away from said second portion, said diaphragm having a sealing bead which extends peripherally about said diaphragm, said sealing bead being disposed in the sealing groove in abutting contact with said first portion to provide a sealing force for said housing assembly and having a resilient spur which in an uninstalled condition has a lateral width wider than the sealing groove and in an installed condition has said spur compressed and deformed by bending in towards said diaphragm to increase the sealing force and to discourage said sealing bead from sliding out of said sealing groove.

2. The switching device according to claim 1, wherein said flexibility characteristic adapts said diaphragm to substantially equalize the difference in pressure across said diaphragm.

3. The switching device according to claim 2, wherein said flexibility characteristic adapts said diaphragm to eliminate the difference in pressure across said diaphragm.

4. The switching device according to claim 1, wherein said diaphragm is adapted to provide a soft, non-slip contact surface for the force applying member.

5. The switching device according to claim 1, wherein said diaphragm is adapted to provide a soft, non-slip contact surface for the force applying member.

6. An automobile switching assembly adapted to permit remote actuation of automotive devices by engagement with a force applying member, comprised of:

an electrical assembly having a printed circuit board, a switch and a switch actuator;

a continuous lower portion having a sealing groove extending peripherally about said lower portion, said lower portion being relatively rigid;

an upper portion having an aperture which permits communication between the force applying member and said switch actuator, said upper portion being relatively rigid and joining said lower portion to form a junction therebetween and to provide an outer shell adapted to protect said electrical assembly against damage from impact;

a one piece, continuous, elastic diaphragm which extends from the junction between said upper portion and said lower portion to cover said electrical assembly, said diaphragm providing a sift, non-slip contact surface for the force applying member, said diaphragm having a flexibility characteristic which adapts said diaphragm to be movable in response to a pressure difference between the pressure internal and the pressure external to the sealed cavity, wherein such movement includes the diaphragm pulling away from said upper portion, said diaphragm in conjunction with said lower portion providing a sealed cavity for said electrical assembly, the sealed cavity having no communication with the external environment of the sealed cavity, said diaphragm having a sealing bead which extends peripherally about said diaphragm and which is disposed in said sealing groove in abutting contact with said first portion to provide a sealing force, said sealing bead having a resilient spur which in an uninstalled condition has a lateral width wiser than the sealing groove and in an installed condition has said spur compressed and deformed by bending in towards said diaphragm to increase the sealing force and to discourage said sealing bead from sliding out of said sealing groove.

7. The switching assembly according to claim 6, wherein said flexibility characteristic adapts said diaphragm to substantially equalize the pressure difference across said diaphragm.

8. The switching assembly according to claim 7, wherein the switch is a mechanically actuated switch.

9. The switching assembly according to claim 7, wherein said diaphragm includes a non-seal portion disposed radially inward of the sealing head, and wherein said flexibility characteristic adapts the entire non-seal portion of the diaphragm to move in response to a difference in pressure across the diaphragm to eliminate the difference between the pressure internal and the pressure external to the sealed cavity.

10. The switching assembly according to claim 6, wherein said upper portion and an adjacent, peripheral edge of said printed circuit board are adapted to provide lateral support to said diaphragm.

11. The switching assembly according to claim 6, wherein said upper portion and an adjacent, peripheral edge of said printed circuit board are adapted to provide lateral support to said diaphragm.

12. A method for providing a sealed cavity for a portable switching assembly, the switching assembly including a continuous lower portion having a sealing groove extending peripherally about the lower portion and a first mating edge, an upper portion having an aperture and a second mating edge adapted to engage the first mating edge in the assembled condition to form a junction therebetween, a one piece, continuous diaphragm which extends from the junction between the lower and upper portion and having a sealing bead extending peripherally about the diaphragm, the sealing bead having a resilient spur adapted to deform longitudinally by bending towards the diaphragm in the assembled condition, and an electrical assembly, comprising the steps of:

(a) positioning the electrical assembly between the lower portion and the diaphragm with the sealing groove and the sealing bead aligned;

(b) positioning the upper portion over the lower portion with the diaphragm therebetween, with the first mating edge and second mating edge aligned;

(c) applying a force to the upper portion and lower portion such that the upper portion drives the sealing bead vertically down into the sealing groove and the sealing groove exerts a longitudinal force longitudinally compressing and deforming the resilient spur; and (d) securing the upper portion to the lower portion.

13. An improved portable, remote switching device of the type having a switch and a housing assembly adapted to permit actuation of the switch by engagement with a force applying member, wherein the improvement comprises:

a continuous first portion having a sealing groove extending peripherally about said first portion;

a one piece, continuous diaphragm having a sealing bead which extends peripherally about said diaphragm, said sealing bead being disposed in the sealing groove in abutting contact with said first portion to provide a sealing force for said housing assembly, wherein said sealing bead has a resilient spur which in an uninstalled condition has a lateral width wider than the sealing groove and in an installed condition said spur compressed and deformed by bending in towards said diaphragm to increase the sealing force and to discourage said sealing bead from sliding out of said sealing groove, wherein said diaphragm is spaced from said first portion leaving a sealed cavity therebetween for the switch, the sealing cavity having no communication with the external environment of the sealed cavity, and said diaphragm having a flexibility characteristic which adapts said diaphragm to be readily moveable in response to a pressure differential between a pressure internal and a pressure external to the sealed cavity.

* * * * *